United States Patent [19]

Vawter et al.

[11] 4,193,760

[45] Mar. 18, 1980

[54] APPARATUS AND METHOD FOR HEATING A PLURALITY OF SOLIDS

[75] Inventors: R. Glenn Vawter, Northridge; Charles S. Waitman, Hacienda Heights, both of Calif.

[73] Assignee: Tosco Corporation, Los Angeles, Calif.

[21] Appl. No.: 883,386

[22] Filed: Mar. 6, 1978

[51] Int. Cl.[2] ..... F28D 15/00

[52] U.S. Cl. ..... 432/96; 432/98; 432/100; 34/167; 34/170

[58] Field of Search ..... 432/27, 100, 215, 96, 432/98; 34/167, 170, 232

[56] References Cited

U.S. PATENT DOCUMENTS

| | | | |
|---|---|---|---|
| 735,919 | 8/1903 | Tregidgo | 432/100 |
| 2,858,123 | 10/1958 | Niems | 34/167 |
| 3,561,927 | 2/1971 | Jones, Jr. | 34/170 |
| 3,595,540 | 7/1971 | Whitecombe | 432/27 |
| 3,832,128 | 8/1974 | Paul | 432/98 |
| 3,913,242 | 10/1975 | Fackler et al. | 34/170 |

*Primary Examiner*—Henry C. Yuen
*Attorney, Agent, or Firm*—Poms, Smith, Lande & Rose

[57] ABSTRACT

In a device for raising the temperature of a plurality of solids which utilizes a heating chamber having at least one hot flue gas inlet and one or more solids inlet apertures to supply concurrent flows of solids and hot flue gas to a heating chamber, and, which utilizes at least one disengager to deflect the heated solids and prevent the solids from being exhausted from the heating chamber along with the hot flue gas, means are provided for coaxially mounting at least one hot flue gas outlet downstream of and displaced from at least one of the solids inlet apertures. Additionally, an individual disengager is associated with each hot flue gas outlet, each disengager being coaxially aligned with and positioned intermediate its associated hot flue gas outlet and a corresponding solids inlet aperture. Each individual disengager is positioned within a direct flow path of solids from a single solids inlet aperture, to prevent thermal stressing of the individual disengager.

9 Claims, 1 Drawing Figure

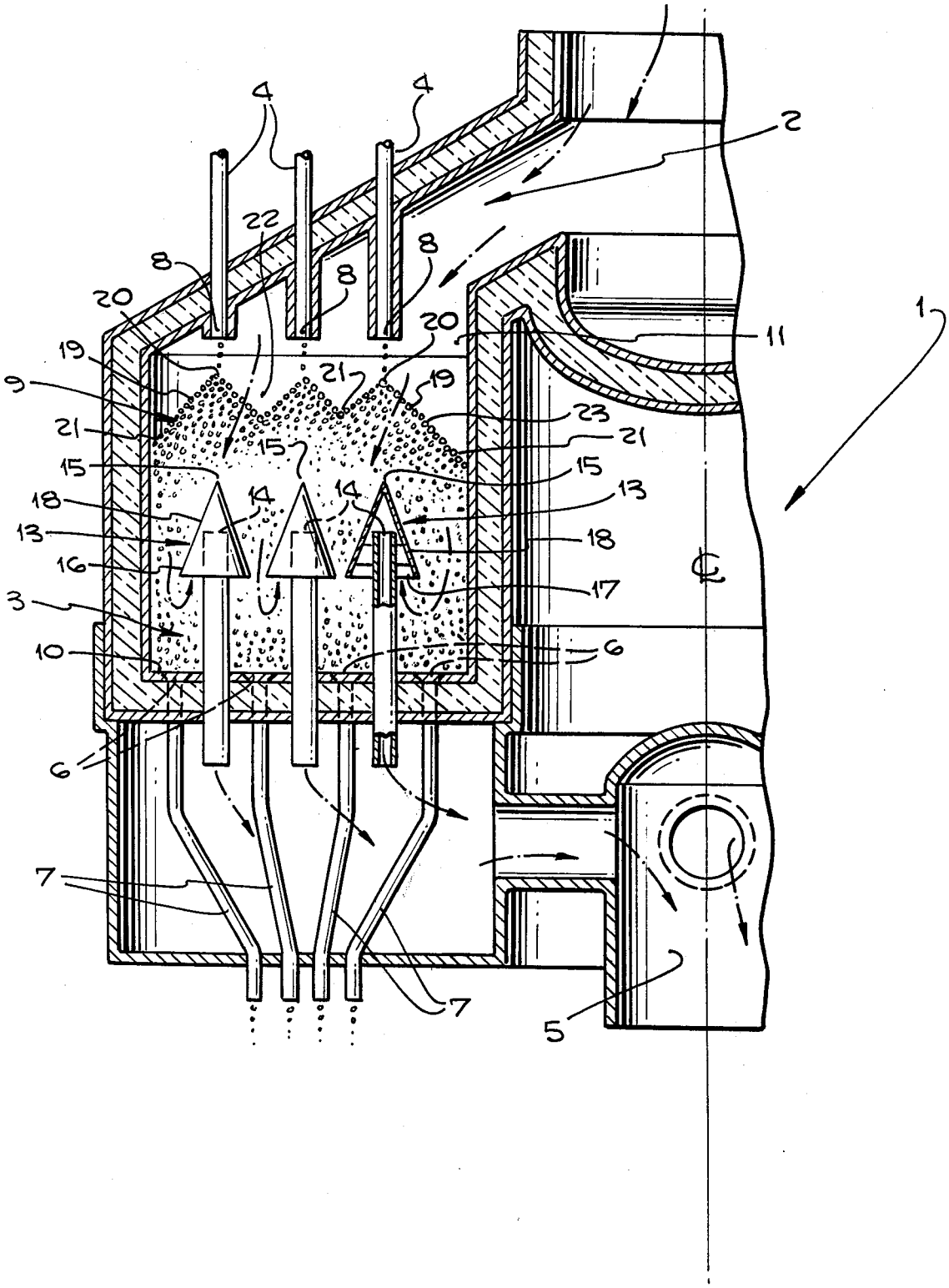
1
2
3
4
4
5
6
6
7
7
8
8
8
9
10
11
13
13
14
14
15
15
15
16
17
18
18
19
19
20
20
21
21
21
22
23

APPARATUS AND METHOD FOR HEATING A PLURALITY OF SOLIDS

BACKGROUND OF THE INVENTION

The present invention relates generally to a device for heating solids. The solids being heated are heat exchange bodies such as metallic or ceramic balls or pebbles, which are preferably used in rotating retorts for heating and crushing materials which are being processed.

Such solid heat exchange bodies, referred to hereinafter as solids, are used in the pyrolytic processing of oil shale or other solid carbonaceous materials. The solids are utilized to heat the carbonaceous material (e.g. oil shale) by exchanging their heat to the material being processed by means of intimate contact therewith. When the carbonaceous materials are heated to the desired temperature, the solids are returned to a device which reheats the solid heat carrying bodies. Typical of such devices for heating solids is the device disclosed in U.S. Pat. No. 3,595,540.

A main characteristic of these devices for heating and/or reheating solids utilizes a flow of solid bodies into a heating chamber. A concurrent flow of hot flue gas is provided to heat the individual solids within the heating chamber. Once the heating function has taken place, it is necessary to separate the concurrent flow of hot flue gas and the now heated solids. Prior art devices have utilized continuous-circumferential channel-like disengagers superimposed over a series of hot flue gas outlets. Due to the high temperatures involved and the systematic nonuniformity of heating of the solids within the heating chamber, there was a tendency for some sections of the channel-like solid disengager to overheat. Sectional overheating created excessive thermal stresses and resulted in warping of the disengager thereby restricting solids flow in parts of the heating device. Also, corrosion of the overheated sections of the disengager was accelerated, thereby reducing the operating life time of the disengager mechanism and necessitating the use of expensive alloys which resist corrosion at elevated temperatures.

SUMMARY OF THE INVENTION

It is, therefore, a primary object of the present invention to disclose and provide disengager means which prevent thermal stress build-up within the disengager mechanism.

It is a further object of the present invention to disclose and provide means for lessening the non-uniform heating of the solids.

It is a still further object of the present invention to disclose and provide means for limiting the extent of intimate contact between the disengager means and the most highly heated of the solids, whereby the operating life of the disengager means is prolonged and less expensive alloys can be used.

In the present invention, an individual disengager means is associated with each one of the hot flue gas outlets, to prevent thermal stressing of the disengagers.

At least one, and preferably all of the hot flue gas outlets are coaxially aligned and displaced downstream with respect to a coaxial flow path of solids from at least one, and preferably all of the solids inlet apertures. Each individual disengager is coaxially aligned intermediate the hot flue gas outlet and the corresponding solids inlet aperture such that each of the individual disengagers is positioned within the direct coaxial flow path of solids from a single solids inlet aperture. As will be shown later, the solids which flow by a direct coaxial flow path from the solids inlet aperture through the heating chamber are the coolest of the solids within the heating chamber and, as a result of the coaxial alignment of the disengagers, the individual disengagers intimately contact a higher proportion of relatively cooler solids within the heating chamber of the solids heating device. This prolongs the operating life of the individual disengagers and allows use of less expensive material.

A more thorough understanding of the present invention will be obtained by those skilled in the art upon consideration of the attached drawings and detailed description of an exemplary embodiment.

BRIEF DESCRIPTION OF THE DRAWINGS

FIG. 1 is a partial side section view of a solids heater which shows the relative relationships between the solids feed tubes, the hot flue gas outlets and the disengagers which separate the cocurrent flow of solids and hot flue gas.

DETAILED DESCRIPTION OF AN EXEMPLARY EMBODIMENT

Referring to FIG. 1, a solids heater is shown generally at 1. Flue gas enters plenum 2 and is distributed to a heating chamber shown generally at 3 which is partially filled with heated solids. The solids are introduced into the heating chamber by solids feed tubes 4 and contact the hot flue gas within the heating chamber. Upon completion of the heating process, the cocurrent flow of now heated solids and hot flue gas is separated. Hot flue gas is directed toward flue gas collector 5 and the heated solids flow through solids outlet apertures 6 into solids outlet tubes 7 and thence to a retort or the like.

As is shown in greater detail in FIG. 1, solids to be heated are gravitationally fed into the heating chamber 3, through solids feed tubes 4 to solids inlet apertures 8. The heating chamber is filled with a bed of solids 9 from the level of the inlet apertures 8 to a base plate 10. A plenum 2 is formed in the portion of the heating chamber 3 above the bed of solids 9. The gas contacts the solids at the top of the bed of solids 11. Both the solids to be heated and the hot flue gas then flow concurrently through heating chamber 3. Heat exchange takes place in the zone of heating chamber 3, defined by the top of bed 11 and base 12 of the conic disengager.

The disengagers 13 deflect the solids which are now heated and prevent the solids from entering the hot flue gas outlets 14 thereby effectively dividing the cocurrent flow into a flow of solids and a separate flow of hot flue gas.

In the exemplary embodiment, each one of the hot flue gas outlets 14 is aligned coaxially with respect to a corresponding one of the solids feed tubes 4 in a position displaced downstream in the direction of coaxial flow from the solids inlet aperture. Further, an individual disengager 13 is associated with each of the hot flue gas outlets 14 and is positioned between the hot flue gas outlet 14 and the corresponding solids inlet aperture 8.

By coaxially aligning the disengager between the solids inlet aperture and the hot flue gas outlet, the individual disengagers are each positioned within a direct flow path of the solids from a single solids inlet aperture. As will be discussed later, this coaxial alignment of the disengagers within the direct flow path of solids from one single solids inlet aperture contributes substantially to the operating life of the disengager and allows for use of a less expensive material.

Additionally, the provision of one individual disengager associated with one hot flue gas outlet prevents the build-up of thermal stress which would occur within a unitary disengager associated with several hot flue gas outlets because of non-uniform heating of the disengager. The thermal stress has caused deformity of unitary disengagers. Such deformation of the unitary disengager is a critical problem because deformation restricts ball flow which has caused severe additional overheating and critical damage of the disengager.

In the exemplary embodiment the individual disengagers 13 are in the form of hollow cones. The apex 15 of the cone is directed upstream of the base 16 in relation to the direct solids flow path. This generally conical shape for the disengagers may have either a circular cross-section or a polygonal cross section. The apex 15 of the disengager is preferably located at a point below apertures 8 where heat exchange between the flue gas and solids is substantially complete.

The hollow conical disengagers 13 are each mounted with respect to their associated hot flue gas outlet 14 so that the outlet extends upwardly into the cone to create freeboard. This freeboard inhibits the elutriation of any of the solids into the hot flue gas outlet 14. The gas enters the disengager 13 through annulus 17. The area of annulus 17 is such that the gas velocity is below that which would fluidize the solids.

In the exemplary embodiment, the configuration of the hollow conical disengagers 13 includes an exterior surface 18. The slope of this surface is sufficient to insure the active flow of solids along this surface thereby preventing build up of solids and debris.

The importance of coaxially alligning each one of the hot flue gas outlets 14 and it's associated disengager 13 within a direct flow path of solids from one single solids inlet aperture 8 relates to the manner in which solids flow through heating chamber 3. As the solids flow from a solids inlet aperture 8 into the bed of solids 9, the solids tend to form generally a conical mound 19 directly under each solids inlet aperture. The solids which tend to roll down the sides of these mounds diverge from a direct flow path and are heated to a relatively higher temperature by virtue of their extended residence time in the high temperature zone at the top of the bed where the flue gas is the hottest. By placing the disengager 13 directly under the inlet aperture 8 and the divergent flow of hottest solids tends to flow through the space between the disengagers, not coming in actual contact therewith. The disengager will come into actual contact mainly with the relatively cooler solids which have flowed by a direct coaxial path from the solids inlet aperture. This exposure of disengager 13 to a high proportion of the relatively cooler solids while limiting exposure to the relatively hotter solids provides for a longer operating life-time of the disengager and also allows for use of a less expensive material. The tops of the bed 20 and the bases 21 of the conical mounds 19 is referred to as the dimple 22. The length of the side surfaces 23 governs the amount of overheating of the solids since those solids forming the surface 23 are directly exposed to the hotter flue gas nearest the plenum 2 and the longer the time the solids are directly exposed to the hotter flue gas from the plenum the hotter the solids get. In the device shown in the U.S. Pat. No. 3,595,540 the maximum side surface 23 is approximately thirty-four inches. In the present invention the maximum length of side is less than about twenty-four inches. It should be noted that the length of side surface 23 is dependent upon the type of material from which the solids are made and the distance between the apertures 8. Once the material from which the solids are made is chosen the distance between apertures 8 can be determined from which the number of solids feed tube 3 can also be determined.

The foregoing is understood to be merely exemplary of the present invention. The only limitations to the breadth of the present invention are contained within the following claims.

We claim:

1. In a device for raising the temperature of a plurality of solids to a higher temperature having heating chamber means with at least one hot flue gas inlet for connection to a source of hot flue gas, at least one hot flue gas outlet, at least one solid inlet aperture for connection to a source of solids which are relatively cooler than said hot flue gas, said solids being fed into said heating chamber means and at least one solids aperture, the improvement comprising the provision of:

individual disengager means associated with said one hot flue gas outlet only such that solids are deflected by said disengager means only relative said one hot flue gas outlet and are prevented from entering said one hot flue gas outlet, and means for coaxially mounting said one hot flue gas outlet downstream of and displaced from said one solids inlet aperture and means for positioning said disengager means intermediate the hot flue gas outlet and solids inlet aperture, whereby said disengager means is positioned within a direct flow path of said solids from said solids inlet aperture and thermal stressing of the individual disengager means possible wherein it is associated with a plurality of hot flue gas outlets is prevented.

2. In a device for raising the temperature of a plurality of solids to a higher temperature having heating chamber means with at least one hot flue gas inlet for connection to a source of hot flue gas, at least one hot flue gas outlet, at least one solids inlet aperture for connection to a source of solids which are relatively cooler than said hot flue gas, said solids being fed into said heating chamber means and at least one solids outlet aperture, the improvement comprising the provision of:

individual disengager means associated with said one hot flue gas outlet only such that solids are deflected by said disengager means only relative said one hot flue gas outlet and are prevented from entering said one hot flue gas outlet, wherein there is a plurality of solids inlet apertures and a corresponding plural number of hot flue gas outlets and further comprising the provision of:

means of coaxially mounting each of said hot flue gas outlets downstream of and displaced from each one of said solids inlet apertures and means for positioning each said disengager means intermediate its associated hot flue gas outlet and solids inlet aperture and within a direct flow path of said solids from a single solids inlet aperture, whereby thermal stressing of the individual disengager means possible where it is associated with a plurality of hot flue gas outlets is prevented.

3. The device of claim 2 wherein each of said disengager means further comprises:

hollow conical means having an apex and a base, said apex being directed upstream in relation to said solids flow path to prevent a build up of solids and debris on said disengager means.

4. The device of claim 3 wherein the area of said base of said hollow conical means is sufficient to prevent fluidizing of the solids.

5. The device of claim 3 wherein said hollow conical means is positioned relative to its associated hot flue gas outlet so that said hot flue gas outlet extends upwardly and interiorly of said conical means towards said apex into a zone defined by an interior surface of said hollow conical means and said base of said hollow conical means.

6. The device of claim 3 wherein said disengager means further comprises:

an exterior surface of said hollow conical means forming an angle of less than 25° with the axis of rotation of said hollow conical means, such that an angular relationship between said exterior surface of said hollow conical means and said flow path of said solids exceeds an angle of friction between said exterior surface and any debris within said heating chamber, whereby particulate matter is prevented from accumulating upon said hollow conical means.

7. In an apparatus for separating a concurrent flow of solids and hot flue gas and raising the temperature of said solids by contact with said flue gas within a heating chamber of a device for raising the temperature of a plurality of solids, said heating chamber having at least one hot flue gas inlet, a plurality of solids inlets, a plurality of hot flue gas outlet, a plurality of individual disengagers for deflecting said solids and preventing said solids from entering said hot flue gas outlets, the improvements comprising:

means for coaxially aligning at least one of said hot flue gas outlets with at least one of said solids inlets in a position displaced in the direction of flow of said solids from said solids inlets, means for positioning at least one of said individual disengagers in association with one gas outlet of said hot flue gas outlets intermediate said one gas outlet and its corresponding solids inlet coaxially aligned within a direct flow path of solids from said corresponding solids inlet.

8. The improvement in apparatus of claim 7 wherein said disengagers each include hollow conical means having an apex, a base, and an exterior surface, said exterior surface forming an angle such that the angular relationship between said exterior surface and the flow path of said solids exceeds an angle of friction between said exterior surface and any debris within said heating chamber to prevent particulate matter from accumulating upon said hollow conical means.

9. A method for separating a concurrent flow of solids and hot flue gas and raising the temperature of said solids by contact with said flue gas within a heating chamber of a device for raising the temperature of a plurality of solids, said heating chamber having at least one hot flue gas inlet, at least one solids inlet, at least one hot flue gas outlet, and at least one disengager for deflecting said solids and preventing said solids from entering said hot flue gas outlet, comprising the steps of:

coaxially aligning at least one of said hot flue gas outlets with at least one of said inlets in a position displaced in the direction of flow of said solids from said solids inlets, providing and positioning individual disengagers in associated with each one of said hot flue gas outlets intermediate said hot flue gas outlet and its corresponding solids inlet coaxially aligned within a direct flow path of solids from said one solids inlet, heating those solids which pass by a direct coaxial flow path through said heating chamber from said solids inlet aperture to a relatively lower temperature than said solids which diverge from said coaxial flow path, flowing a concurrent flow of solids and hot flue gas over said individual disengagers whereby said solids are prevented from entering said hot flue gas outlets, being deflected therefrom by said individual disengagers, and contacting said individual disengagers substantially only with said coaxially flowing solids which have been heated to a relatively lower temperature.

* * * * *